United States Patent [19]

Paris

[11] Patent Number: 4,629,505

[45] Date of Patent: Dec. 16, 1986

[54] ALUMINUM BASE ALLOY POWDER METALLURGY PROCESS AND PRODUCT

[75] Inventor: Henry G. Paris, San Diego, Calif.

[73] Assignee: Aluminum Company of America, Pittsburgh, Pa.

[21] Appl. No.: 718,861

[22] Filed: Apr. 2, 1985

[51] Int. Cl.[4] ..... B22F 1/00

[52] U.S. Cl. ..... 75/228; 75/245; 420/533; 420/535; 420/543; 420/553; 148/126.1; 148/439; 419/25; 419/67; 419/28

[58] Field of Search ..... 420/533, 535, 543, 553; 419/25, 28, 67; 148/126.1, 439; 75/228, 245

[56] References Cited

U.S. PATENT DOCUMENTS

| | | | |
|---|---|---|---|
| 3,876,474 | 4/1975 | Watts et al. | 148/32 |
| 3,899,820 | 8/1975 | Read et al. | 29/420.5 |
| 4,347,076 | 8/1982 | Ray et al. | 75/0.5 R |

*Primary Examiner*—Stephen J. Lechert, Jr.
*Attorney, Agent, or Firm*—Daniel A. Sullivan, Jr.

[57] ABSTRACT

A metallurgical method including cooling molten aluminum particles and consolidating resulting solidified particles into a multiparticle body, wherein the improvement comprises the provision of greater than 0.15% of a metal which diffuses in the aluminum solid state at a rate less than that of Mn.

Aluminum containing greater than 0.15% of a metal which diffuses in the aluminum solid state at a rate less than that of Mn.

7 Claims, 5 Drawing Figures

ALUMINUM BASE ALLOY POWDER METALLURGY PROCESS AND PRODUCT

SUMMARY OF THE INVENTION

The invention described herein was made in the performance of work under NASA Contract No. NAS1-16048 and is subject to the provisions of Section 305 of the National Aeronautics and Space Act of 1958 (72 Stat. 435; 42 U.S.C. 2457).

It is an object of the invention to provide method and product yielding improved properties, for instance mechanical properties.

This as well as other objects which will become apparent from the discussion that follows are achieved, according to the present invention, by providing (1) a metallurgical method including cooling molten aluminum particles and consolidating resulting solidified particles into a multiparticle body, wherein the improvement comprises the provision of greater than 0.15% of a metal which diffuses in the aluminum solid state at a rate less than that of Mn, and (2) aluminum containing greater than 0.15% of a metal which diffuses in the aluminum solid state at a rate less than that of Mn.

GENERAL ASPECTS OF THE INVENTION

Figure 1A:
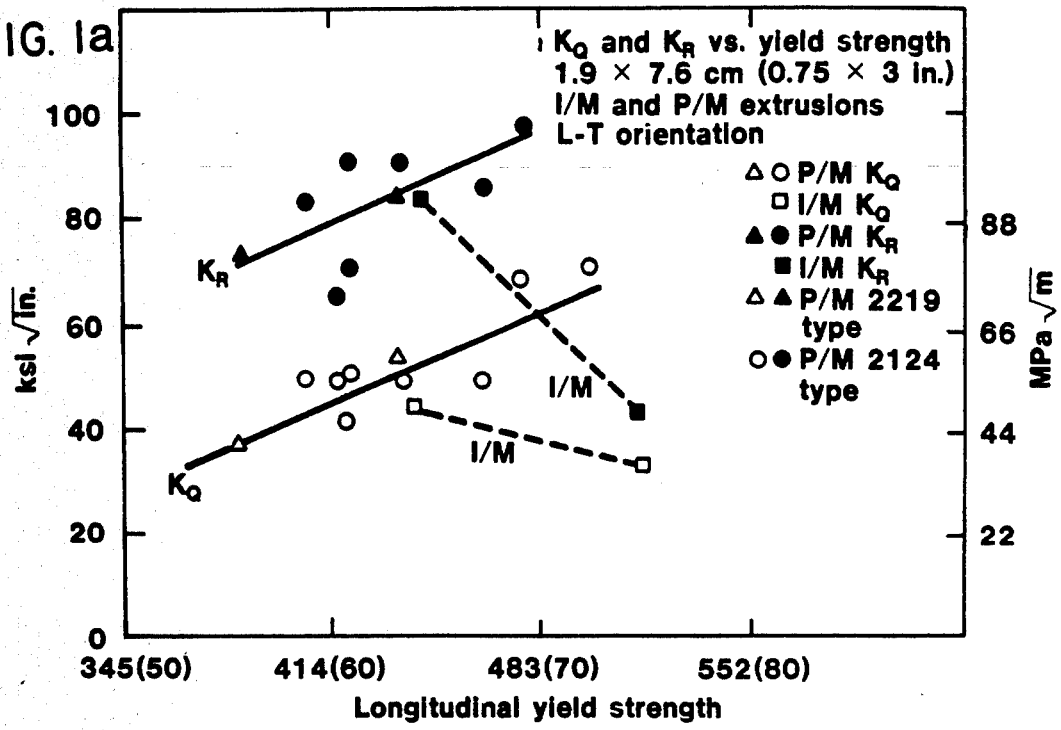
FIG. 1 shows toughness vs. yield strength relationships in extrusion and plate, as follows: (a) the dependency of $K_q$ and $K_r$ on yield strength of extrusions and (b) the dependency of Charpy toughness on yield strength of 6.35 mm plate.

In its broad format, this invention uses rapid cooling as achieved, e.g. in atomization or splat cooling, e.g. cooling rates in the range of $10^4$° to $10^6$° C./sec., to introduce, into aluminum metal, highly insoluble, slow diffusers, such as zirconium, at higher levels than previously used.

These slow diffusers, which have relatively high solubility in the molten Al, exist at first in a metastable solid solution state and later form fine precipitates, of e.g. $ZrAl_3$, which act to resist recrystallization, i.e. act to keep grain size about at the size of the particles resulting from the atomization or splat cooling.

To the extent that there is some recrystallization and grain growth, the low diffusivity keeps the $ZrAl_3$ small such that it acts as a strengthener.

In general, the slow diffusers used in the present invention also are highly insoluble in Al, i.e. equilibrium solubility less than 0.1% at temperatures below the solidus.

The invention offers unique combinations of strength and toughness for e.g. 2XXX alloys and significantly higher strength in their product sections than ingot metallurgy (I/M) alloys. It furthermore provides a very good matrix for metal matrix composites due to its superior strength-ductility and its chemistry which enhances interface bonding with silicon carbide ceramic.

A specific composition of 3.7 wt % Cu, 1.8 wt % Mg, 0.6 wt % Zr, 0.15 wt % Mn with the balance aluminum, except for standard level of impurities of elements Si, Fe, Zn, etc., has been produced and tested with these properties:

| | Naturally Aged | Aged 16 Hours at 350° F. |
|---|---|---|
| 0.25 Plate | 61.9 ksi yield, 74.6 ksi tensile | 65.4 ksi yield, 69.7 ksi tensile |
| 0.07 Sheet | 55.4 ksi yield, 69.4 ksi tensile | 64.1 ksi yield, 69.1 ksi tensile |

Yield strength and tensile strength vs. product size shows these improvements for similar I/M and P/M (powder metallurgy) alloys.

| | I/M | | P/M | |
|---|---|---|---|---|
| Thickness | YS (ksi) | TS (ksi) | YS (ksi) | TS (ksi) |
| 0.07 in. | 42 | 68 | 55.4 | 68.4 |
| 0.25 in. | 49 | 70 | 61.9 | 74.6 |

This concept also will be applicable to other 2XXX alloys such as Al-6% Cu, which in an example of the invention would include 0.5% Zr.

The invention embodies the use of high levels of zirconium which cannot be cast usefully in ingot metallurgy techniques but which are easily cast using rapid solidification.

Rapid solidification also imparts control of insoluble constituent particle size to improve toughness.

This alloy type also shows similar improvements in strength and toughness in the product form of extrusions.

SYNOPSIS

The benefit of rapid solidification processing of 2XXX aluminum alloy compositions over ingot metallurgy processing was evaluated by comparison with an ingot metallurgy control alloy. The P/M alloy extrusions showed a reduced age hardening response compared to similar I/M compositions with higher naturally aged tensile properties but lower artificially aged properties. However, the tensile properties of naturally and artificially aged P/M alloy extrusions based on a version of I/M 2034 but containing 0.6 wt % Zr were comparable to the I/M control extrusions and had significantly superior combinations of strength and toughness. The tensile properties of this P/M alloy showed even greater advantage in 6.4 mm (0.25 in.) and 1.8 mm (0.070 in.) plate and sheet, the yield strength being about 8 MPa (10 ksi) larger than reported values for the I/M 2034 alloy sheet. An artificially aged P/M alloy based on 2219 also showed comparable strength and strength-toughness combination to the P/M Al-Cu-Mg-Zr alloy, substantially outperforming I/M 2219. These results show that rapid solidification offers the flexibility to modify conventional I/M compositions to produce new alloy compositions with superior mechanical properties.

INTRODUCTION

Rapid solidification processing has produced significant improvements in the notched fatigue strength and the combination of strength and fracture toughness of solution heat treatable 7XXX alloys (1). The 2XXX ingot metallurgy (I/M) aluminum alloys based on Al-Cu and Al-Cu-Mg, particularly 2219, 2618, 2024 and their later improvements (Table 1) are widely used in aircraft structures where fatigue and fracture resistance and elevated temperature strength are important design considerations. Extending the favorable property combinations of I/M 2XXX alloys through rapid solidification processing using powder metallurgy (P/M) would be of considerable value to aerospace design and construction. While some evaluation of the benefit of rapid solidification has been done on specific 2XXX compositions (2, 3), no systematic exploration of the 2XXX alloy systems using rapid solidification has been undertaken. This paper presents the results of a systematic study to identify and develop P/M 2XXX alloys conducted at Alcoa Laboratories and Lockheed-California Company under support of NASA - Langley Research Center (4-6).

The alloys of Table 2 were evaluated. The more promising alloys involved a modified 2024 composition which contained substantial amounts of zirconium added. The manganese level in these alloys was reduced and the copper and magnesium subsequently modified to compensate for this reduced manganese level. These P/M 2XXX alloy extrusions showed comparable strengths to an I/M control and had substantial improvement in toughness and S-N notched ($K_t=3$) fatigue strength (4-6). The improved P/M composition showed a marked advantage in tensile properties and toughness in the product forms of plate and sheet due to the ability of the P/M microstructure to better control recrystallization and grain growth processes.

TABLE 1

Typical 2XXX Ingot Metallurgy Alloy Compositions

| | Cu | Mg | Mn | Fe | Si | Ni | Zr | Al |
|---|---|---|---|---|---|---|---|---|
| 2124 | 4.4 | 1.5 | 0.6 | 0.2 | 0.3 | — | — | bal |
| 2034* | 4.2 | 1.5 | 0.8 | 0.05 | 0.03 | — | 0.1 | bal |
| 2618 | 2.3 | 1.5 | — | 1.1 | 0.15 | 1.05 | — | bal |
| 2219 | 6.3 | 0.02 | 0.3 | 0.3 | 0.2 | — | — | bal |

*modified 2124

TABLE 2

The P/M 2XXX Alloy Chemistries

| | | Cu | Mg | Si | Fe | Ni | Mn | Zr |
|---|---|---|---|---|---|---|---|---|
| Al—Cu—Mg | | | | | | | | |
| 2024 type: | | | | | | | | |
| 513708 | A | 3.93 | 1.57 | — | 0.06 | 0.01 | 1.50 | — |
| | T | 4.00 | 1.60 | — | — | — | 1.50 | — |
| 513709 | A | 4.06 | 1.62 | — | 0.05 | — | 0.51 | — |
| | T | 4.00 | 1.60 | — | — | — | 0.50 | — |
| 514041 | A | 3.73 | 1.81 | 0.02 | 0.04 | 0.01 | 0.14 | 0.12 |
| | T | 3.70 | 1.85 | — | — | — | 0.20 | 0.14 |
| 514042 | A | 3.67 | 1.84 | 0.03 | 0.03 | 0.04 | 0.16 | 0.60 |
| | T | 3.70 | 1.95 | — | — | — | 0.20 | 0.70 |
| I/M: | | | | | | | | |
| 503315 | A | 4.36 | 1.56 | 0.07 | 0.06 | 0.00 | 0.90 | 0.10 |
| | T | 4.30 | 1.50 | — | — | — | 0.90 | 0.12 |
| 2618 type: | | | | | | | | |
| 513707 | A | 3.80 | 1.93 | 0.07 | 1.53 | 1.73 | 0.01 | |
| | T | 3.80 | 1.80 | 0.15 | 1.50 | 1.50 | — | |
| 513888 | A | 3.32 | 1.67 | 0.06 | 1.03 | 0.93 | 0.01 | |
| | T | 3.50 | 1.65 | 0.20 | 1.20 | 1.10 | — | |
| 513889 | A | 3.19 | 1.67 | 0.24 | 0.07 | — | 0.01 | |
| | T | 3.50 | 1.65 | 0.20 | — | — | — | |
| Al—Cu | | | | | | | | |
| 2219 type: | | | | | | | | |
| 513887 | A | 5.19 | 0.38 | 0.12 | 0.06 | — | 0.18 | |
| | T | 5.50 | 0.35 | — | — | — | 0.30 | |

PROCEDURE

The alloys used in this study were produced by gas atomization of fine powders. The average powder size (APD) of the alloy powder lots was maintained between 12 and 15 micrometers. Billets of the standard 50 Kgm (110 lb.) size were produced using consolidation and vacuum hot pressing practices originally developed for 7XXX P/M alloys (7-12). Vacuum hot pressing and subsequent fabrication temperatures were modified to accommodate the Al-Cu-Mg-Mn alloy compositions. These modifications are noted in detail elsewhere (4-6). The target and actual alloy compositions are noted in Table 2. To assess the effects actually due to rapid solidification processing, an I/M control with a similar composition (Alloy 503315) to one of the P/M alloys (514041) was used. It was cast as a 15.3 cm (6 in.) diameter ingot, stress relieved, scalped and extruded with the powder alloys. Flat bars of 7.6 cm×1.9 cm (3×0.75 in.) cross section were directly extruded at 625° K. (666° F.). Both 6.4 mm (0.25 in.) thick plate and 1.8 mm (0.070 in.) thick sheet of the more promising composition (Alloy 514163) were produced from an additional run of powder. Rolling stock was prepared by directly forging a 50 Kgm (110 lb.) billet into a 5 cm (2 in.) slab on open dies. This slab was cut into four pieces approximately 50 cm long by 15 cm wide (20 in.×6 in.) for unidirectional rolling. Two microstructures were attempted in the plate, one produced by rolling at 740° K. (875° F.) was intended to produce a more unrecrystallized microstructure, and one by annealing and rolling in the range of 533° K.-644° K. (500°-700° F.) was intended to produce a more recrystallized microstructure. These extremes were selected to evaluate the mechanical property response of the limiting microstructures produced in a production process. The processing was not totally successful in producing these variations as the zirconium containing microstructure was highly resistant to recrystallization. Due to the small size of the billets and the small rolling mill, the processing schemes also did not represent realistic fabrication schedules involving large billet stock which might be used to obtain such microstructures. A sheet gage also was produced in two microstructural variants by similar processing of one additional hot rolled slab.

Standard metallographic procedures were used to examine the microstructures. Pole figures from (111) diffraction were obtained on an automated Rigaku diffractometer. The data were corrected for absorption and compared to a randomly oriented aluminum standard.

Mechanical testing was performed with specimen configurations and procedures according to existing ASTM standards. Tapered seat, 0.64 cm (0.25 in.) diameter gage tensile specimen were used for tensile tests of extrusions, while full thickness, flat specimen were used for plate and sheet. Full thickness compact tension (CT) specimen from the extrusions were tested by the methods of ASTM-E399, and either full thickness, precracked Charpy specimens (plate) or Kahn tear specimen (sheet) used to evaluate toughness.

RESULTS

Extrusions

The tensile properties of extrusions of the three classes of P/M alloys are summarized in Table 3. These results show that the alloy compositions based approximately on 2024 demonstrate the highest yield and tensile strengths in the naturally aged (NA) tempers. The artificially aged (PA) tempers of the P/M alloys rank similarly, although the tensile strengths of the alloy similar to 2219 (513887) are comparable to that of the alloys similar to 2024. The age hardening response of the P/M alloys is modest compared to similar I/M compositions. The P/M alloys show about half the hardening capacity of an I/M alloy. Typically, the tensile strengths decrease on aging.

Alloys 514041, 514042 are modifications of the two alloys, 513708 and 513709. The dispersoid forming element zirconium had been substituted for manganese. The Mn content was reduced approximately to the maximum solid solubility at the solution heat treatment temperature since manganese is a solid solution and has a beneficial effect on hardening precipitation (13). The excess copper content, which normally would combine with the manganese to form constituent or dispersoid, was lowered to maintain the copper content near but not above the maximum solubility at solution heat treatment temperature. Since Zr forms the coherent dispersoid, $Al_3Zr$, it was anticipated to control recrystallization more effectively than manganese and not to degrade toughness by its smaller, coherent character (14, 15). Furthermore, since zirconium is a very slowly diffusing element in aluminum, its second phase distribution was expected to be more resistant to coarsening during hot working than the manganese dispersoid/constituents. Rapid solidification offered the possibility of obtaining an additional age hardening contribution by increasing the amount of zirconium added to the alloy in excess of solid solubility. The tensile properties in Table 4 supports these hypotheses. The naturally aged extrusions of the Al-Cu-Mg-Zr alloy had improved strength-toughness combination over the P/M Al-Cu-Mg-Mn alloy. The artificially aged extrusions showed substantial hardening, producing the highest yield strength among the P/M alloys.

TABLE 3

Tensile Properties of 2XXX P/M and I/M Extrusions

| Alloy | Temper (1) | Yield Strength MPa | Yield Strength (ksi) | Tensile Strength MPa | Tensile Strength (ksi) | El. (%) | R.A. (%) |
|---|---|---|---|---|---|---|---|
| 2024 type: | | | | | | | |
| 513708 | NA | 420 | (60.9) | 520 | (75.4) | 10 | — |
| | PA (2) | 453 | (65.7) | 494 | (72.7) | 10 | — |
| 513709 | NA | 419 | (60.8) | 518 | (75.1) | 16 | — |
| | PA (2) | 451 | (66.1) | 497 | (72.7) | 14 | — |
| 514041 | NA | 438 | (63.5) | 536 | (77.6) | 18 | 20 |
| | PA (3) | 494 | (71.6) | 533 | (77.3) | 13 | 27 |
| 514042 | NA | 463 | (67.2) | 571 | (82.8) | 15 | 19 |
| | PA (3) | 508 | (73.7) | 548 | (79.4) | 13 | 29 |
| I/M: | | | | | | | |
| 503315 | NA | 442 | (64.1) | 572 | (82.8) | 14 | 13 |
| | PA (3) | 525 | (76.1) | 570 | (82.6) | 11 | 25 |
| 2618 type: | | | | | | | |
| 513707 | NA | 384 | (55.7) | 484 | (70.2) | 12 | |
| | PA (4) | 407 | (59.0) | 455 | (66.0) | 10 | |
| 513888 | NA | 360 | (52.2) | 470 | (68.1) | 16 | 13 |
| | PA (5) | 364 | (52.8) | 420 | (60.9) | 13 | 42 |
| 513889 | NA | 388 | (56.2) | 506 | (73.3) | 16 | 15 |
| | PA (6) | 418 | (60.6) | 471 | (68.3) | 13 | 28 |
| 2219 type: | | | | | | | |
| 513887 | NA | 383 | (55.4) | 498 | (72.3) | 15 | 15 |
| | PA (7) | 436 | (63.2) | 514 | (74.5) | 14 | 33 |

Notes:
(1) NA designates natural age and PA designates peak age; all alloys were stress relieved by stretching 1.5%–2.0%.
(2) Solution heat treated at 766° K. (920° F.), PA - 12 hours at 450° K. (350° F.).
(3) Solution heat treated at 775° K. (935° F.), PA - 4 hours at 464° K. (375° F.).
(4) Solution heat treated at 766° K. (920° F.), PA - 12 hours at 464° K. (375° F.).
(5) Solution heat treated at 772° K. (940° F.), PA - 8 hours at 464° K. (375° F.).
(6) Solution heat treated at 772° K. (940° F.), PA - 4 hours at 464° K. (375° F.).
(7) Solution heat treated at 802° K. (985° F.), PA - 4 hours at 450° K. (350° F.).

Table 4 lists the strength-toughness values for the alloy extrusions. Both $K_q$ (5% secant) and $K_r$ (25% secant) are plotted in FIG. 1*a*. The $K_q$ data showed a well behaved, but inverse strength-toughness dependency. A least-squares line was fitted to the data. The P/M data markedly outperformed the I/M control, especially in the artificially aged condition. FIG. 1*a* also shows the yield strength-$K_r$ (25% secant) relationship. Although a line also was fitted to this data to show the trend of the data, the data could as easily be described by the average toughness, except for the aged 0.5% Zr containing alloy. Inspection of the data in Table 4 suggested that the 2024-type alloy with added manganese (513708) and the naturally aged 2219 analogue (513887) have decidedly poorer strength-toughness relationships than the other alloys. The trend of increasing toughness with increasing strength observed in the aged 2034-type P/M alloy with high zirconium addition was similar to that seen in the $K_q$ values.

Both toughness indicators for the I/M alloy showed the expected trend of decreasing toughness with increasing strength. The strength-toughness combination of the aged I/M alloy was markedly inferior to the combinations shown by the comparable P/M alloy. The reversed trend of the P/M data, i.e., increasing toughness with increasing strength in both the $K_q$ and $K_r$ was unexpected but reproduced on retesting. In both measures of toughness, the separation of the values for the aged P/M alloy with 0.6 wt % Zr resulted in a basically flat response with change in strength. Even this result implies a distinct improvement in toughness response in the aged tempers of these zirconium containing P/M alloys. This observed relationship may reflect effects related to differences in slip mode and/or grain boundary precipitation characteristics. Until further microstructural examination clarifies the cause of these trends, the data should be used only to indicate that the P/M alloy definitely outperformed the I/M control composition.

TABLE 4

The Strength-Toughness Combinations for 2XXX P/M and I/M Alloys

| Alloy | Temper (1) | Yield Strength MPa | Yield Strength (ksi) | $K_Q$ (5% Secant) MPa m$^{(\frac{1}{2})}$ | $K_Q$ (5% Secant) (ksi in.$^{(\frac{1}{2})}$) | $K_r$ (25% Secant) MPa m$^{(\frac{1}{2})}$ | $K_r$ (25% Secant) (ksi in.$^{(\frac{1}{2})}$) |
|---|---|---|---|---|---|---|---|
| 2024 type: | | | | | | | |
| 513708 | NA | 420 | (60.9) | 44.6 | (40.6) | 78.8 | (71.7) |
| | OA (1) | 410 | (60.3) | 53.0 | (48.2) | 72.3 | (65.8) |
| 513709 | NA | 419 | (60.8) | 55.7 | (50.7) | 100.2 | (91.2) |
| | OA (1) | 405 | (58.7) | 53.3 | (48.5) | 91.9 | (83.6) |
| 514041 | NA | 438 | (63.5) | 53.9 | (49.0) | 100.1 | (91.0) |
| | PA (2) | 476 | (69.0) | 75.2 | (68.4) | 108.5 | (98.6) |
| 514042 | NA | 463 | (67.2) | 53.8 | (49.0) | 95.2 | (86.6) |
| | PA (2) | | (72.9) | 78.9 | (71.7) | 84.7 | (77.0) |
| 503315 | NA | 442 | (64.1) | 48.7 | (44.3) | 93.1 | (84.8) |
| | PA (3) | | (75.6) | 36.7 | (33.4) | 65.5 | (59.5) |
| 2618 type: | | | | | | | |
| 513707 | NA | 384 | (55.7) | 42.2 | (38.4) | 71.3 | (64.7) |
| | OA (1) | 407 | (59.0) | 41.0 | (37.3) | 55.7 | (50.7) |
| 513888 | NA | 403 | (58.5) | 45.8 | (41.6) | 88.6 | (80.6) |
| | PA (4) | 414 | (60.0) | 55.1 | (50.1) | 95.6 | (87.0) |
| 513889 | NA | 425 | (61.6) | 45.0 | (40.6) | 67.4 | (61.3) |
| | PA (4) | 421 | (61.1) | 38.1 | (34.7) | 54.2 | (49.3) |
| 2219 type: | | | | | | | |
| 513887 | NA | 383 | (55.4) | 40.7 | (37.1) | 81.4 | (74.0) |
| | PA (5) | 436 | (63.2) | 59.1 | (53.8) | 93.1 | (84.8) |

Notes:
(1) aged 12 hours at 464° K. (375° F.), (overaged).
(2) aged 4 hours at 464° K. (375° F.).
(3) aged 12 hours at 450° K. (350° F.).
(4) aged 16 hours at 450° K. (350° F.).
(5) aged 4 hours at 450° K. (350° F.).

Plate and Sheet

Figure 2A:
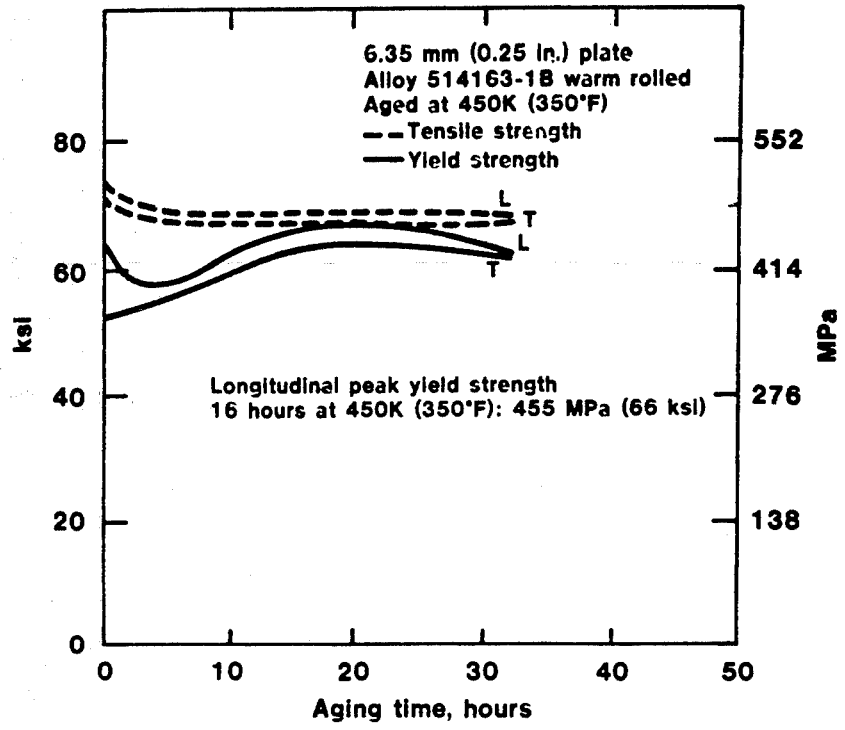
FIG. 2 shows the aging response at 450° K. of warm rolled plate and sheet as follows: (a) the warm rolled 6.35 mm plate and (b) the warm rolled 1.8 mm sheet.
Figure 2B:
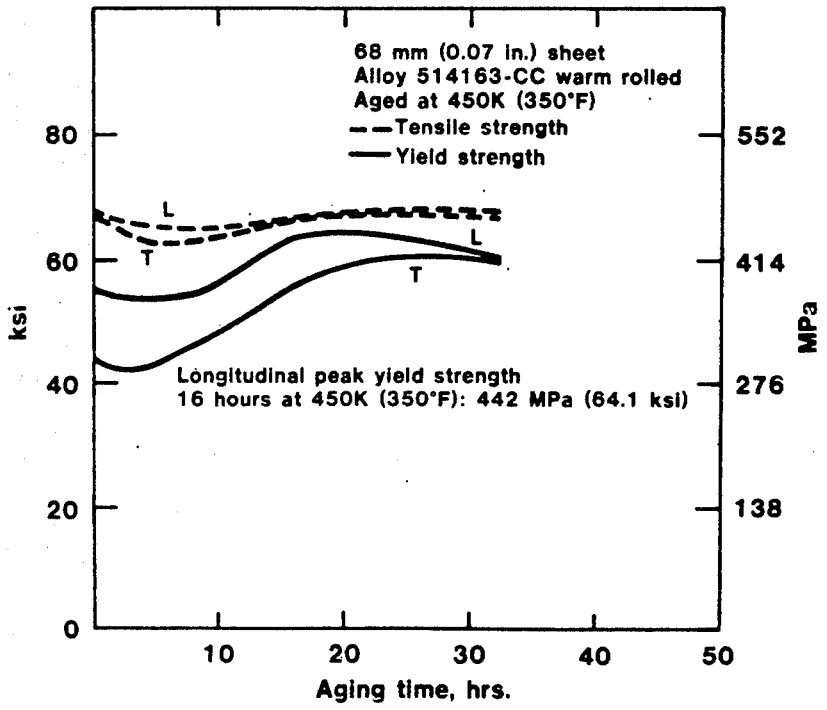

The Al-Cu-Mg-Zr alloy composition which showed the promising tensile and toughness results in extrusion (514042) was also evaluated in the product forms of plate and sheet. FIGS. 2*a* and *b* show the age hardening response of the plate and sheet at 450° K. (350° F.), respectively. Aging at 450° K. and 463° K. (350° F. and 375° F.) produced essentially equivalent yield and tensile strengths. This Figure illustrates a characteristic of the aging behavior observed in the extrusions of Table 3. On aging the P/M extrusions, the tensile strength continuously decreased, while a modest increase in yield strength was observed. FIG. 2 shows that the plate also had similar behavior to the extrusions, while the sheet showed a distinct hardening of both yield and tensile strengths. The additional hardening in the sheet to the same strength level as the plate is notable since the naturally aged yield strength of the sheet is lower than that of the plate.

Only small differences in longitudinal tensile properties were observed between the two process variants. Aging temperature influenced the longitudinal and transverse tensile properties differently. The 450° K. (350° F.) aging temperature produced more isotropic tensile properties than did the 463° K. (375° F.) aging temperature. For practical considerations, the differences in tensile properties of the two process conditions were not large. The tensile properties of the 1.6 mm (0.070 in.) sheet are most impressive. While the naturally aged sheet shows a marked loss in strength relative to the plate as would be expected from recrystallization, the tensile properties of the sheet after aging essentially reproduced those of the plate. In ingot alloys, one typically observes a marked decrease in tensile properties of such thin sheet relative to thicker plate.

Figure 1B:
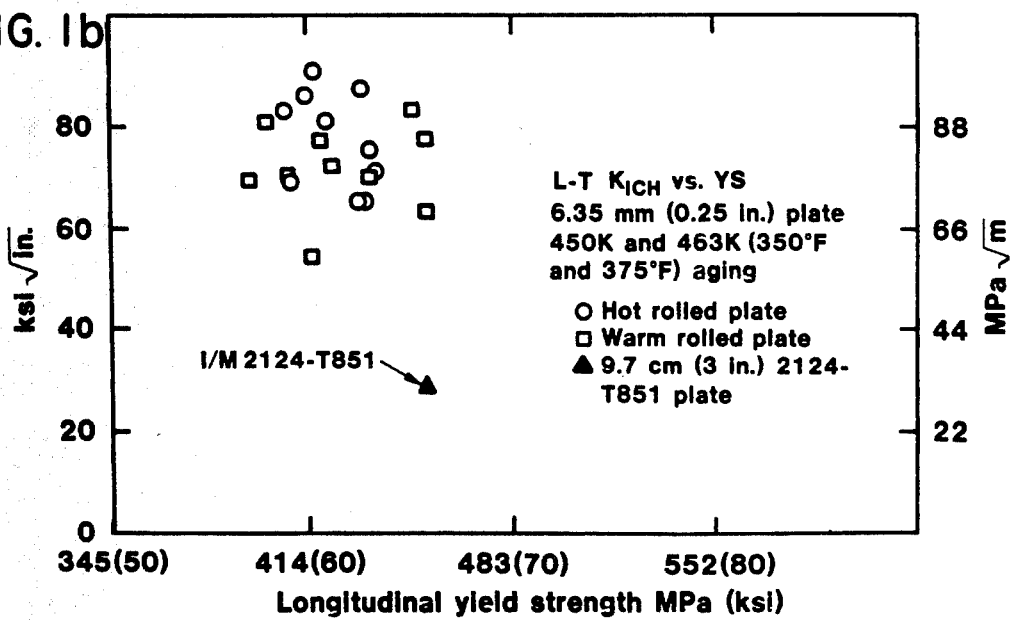

The data for yield strength and L-T precracked Charpy toughness are plotted in FIG. 1*b*. The data do not yield a clear linear relationship. The yield strengths were scattered between 407–448 MPa (59–65 ksi), but the Charpy toughness varied markedly between 55–99 MPa m$^{(\frac{1}{2})}$ (50–90 ksi in.$^{(\frac{1}{2})}$).

The toughness number was calculated by the empirical formula:

$$K=[(E)*(W/A)/2*(1-\mu)]^{\frac{1}{2}}$$

according to practices found to be suitable for aluminum alloys at our laboratory. It must be recognized that these Charpy toughness data are used primarily as an inexpensive screening tool. Values of Charpy toughness in excess of about 25–30 MPa m$^{(\frac{1}{2})}$ significantly overestimate true plane strain fracture toughness (16).

The best combinations of strength and toughness are found in the hot rolled plate aged between 4 and 8 hours at 450° K. (350° F.), and in the warm rolled plate aged between 4 and 8 hours at 463° K. (375° F.). The poorest strength-toughness combinations are observed in alloys overaged at 463° K. (375° F.).

FIG. 1*b* also contains a precracked Charpy estimate of the L-T plane strain toughness of 7.6 cm (2.99 in.) 2124-T851 plate. Although the 2124 data is from thicker plate than that of the P/M alloys, the comparison is an indication of the magnitude of improvement in toughness and strength over I/M processing achieved using P/M processing.

Figure 3A:
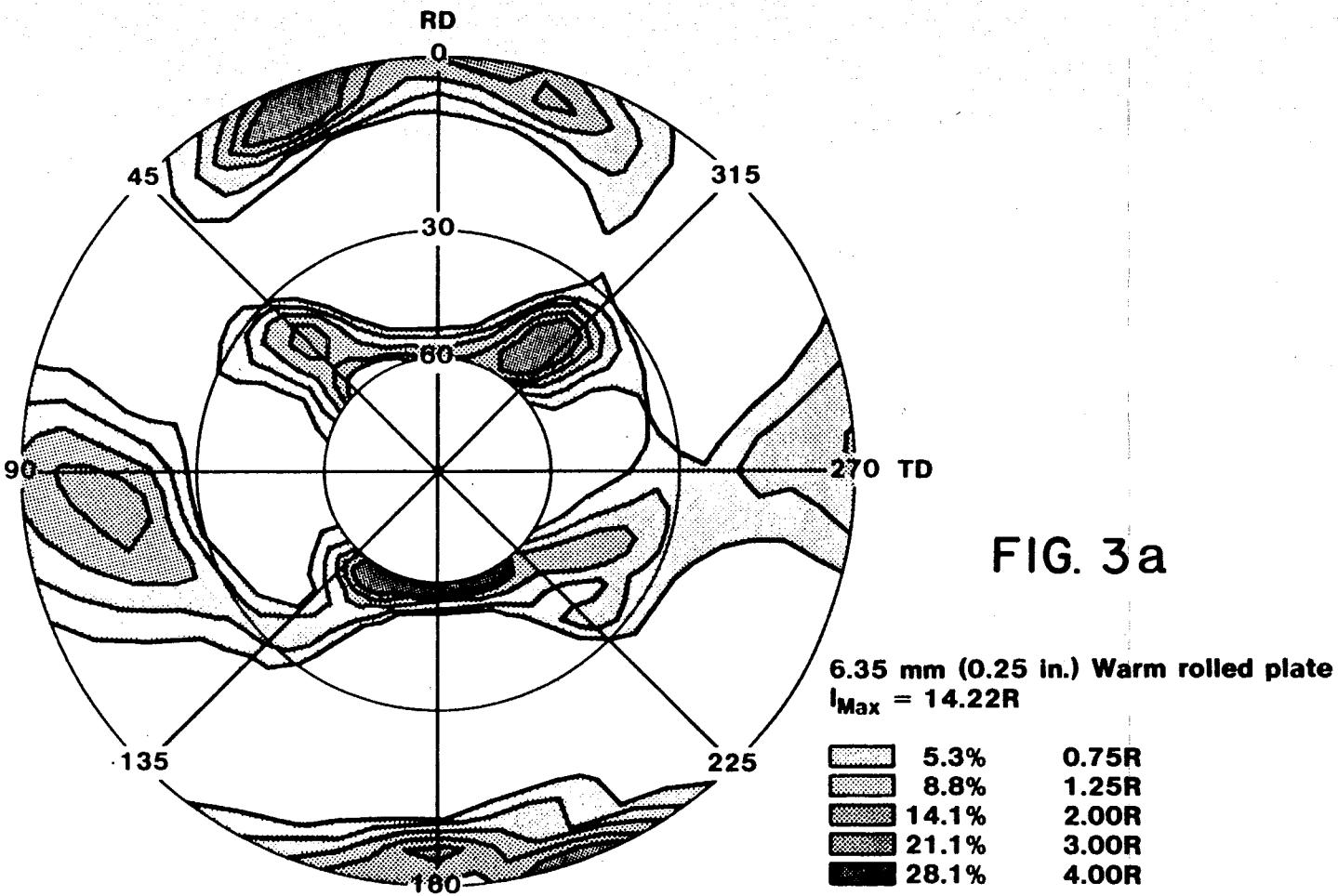
FIG. 3 shows the (111) pole figures of hot and warm rolled plate after heat treatment, as follows: (a) warm rolled 6.35 mm plate and (b) hot rolled 6.35 mm plate.
Figure 3B:
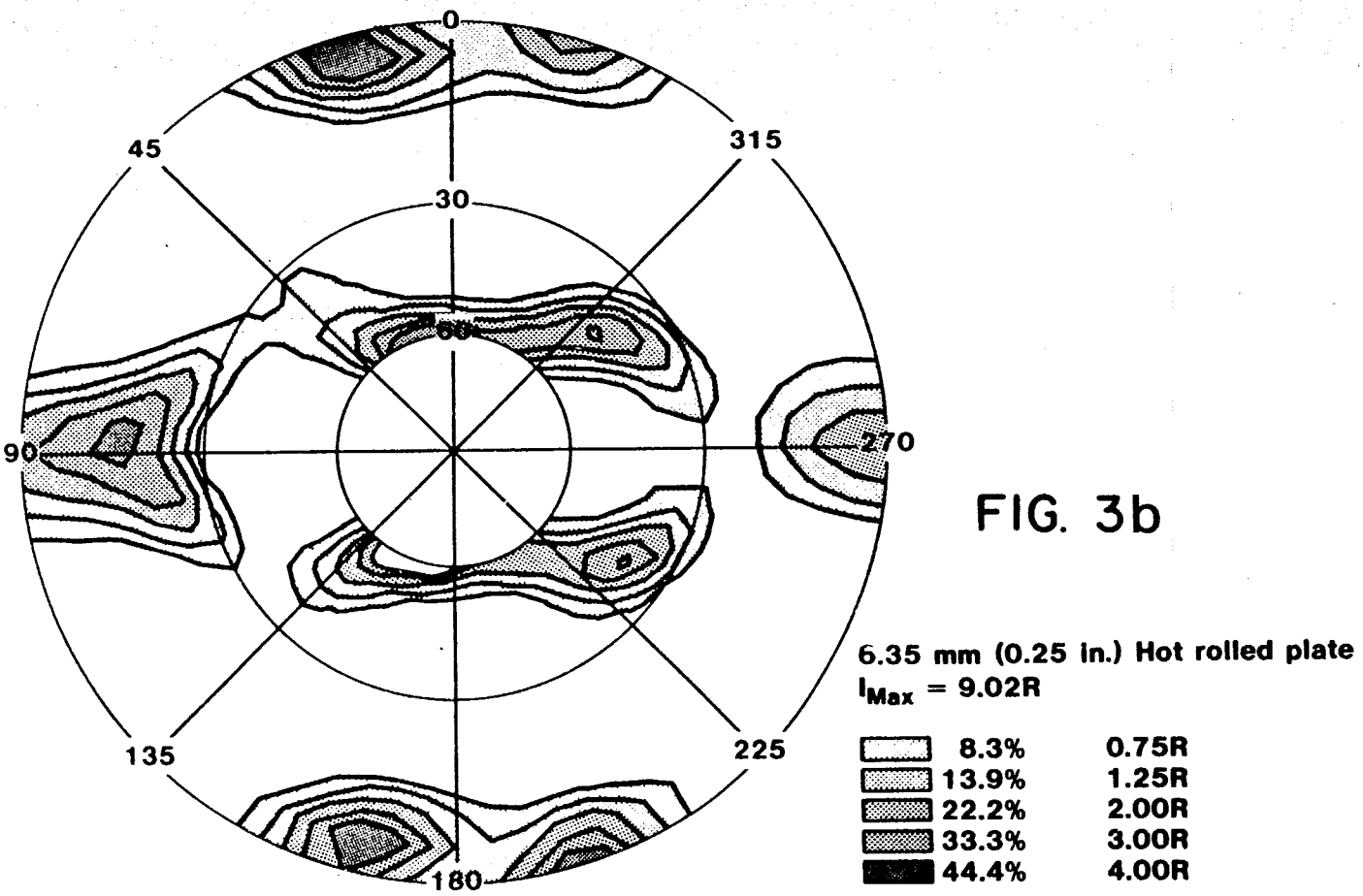
Figure 4A:
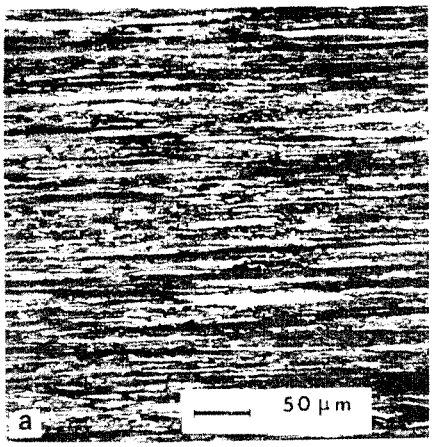
FIG. 4 shows grain structures of billet, plate and sheet as follows: (a) the T/2 longitudinal billet structure: (b) the T/2 longitudinal hot rolled plate grain structure after heat treatment: (c) the T/2 longitudinal warm rolled grain structure after heat treatment: (d) the T/2 longitudinal hot rolled sheet grain structure after heat treatment; and (e) the T/2 longitudinal warm rolled grain structure after heat treatment. "T/2" means "at midplane", i.e. located in the plate or sheet one-half way through the thickness T.
Figures 4B, 4C:
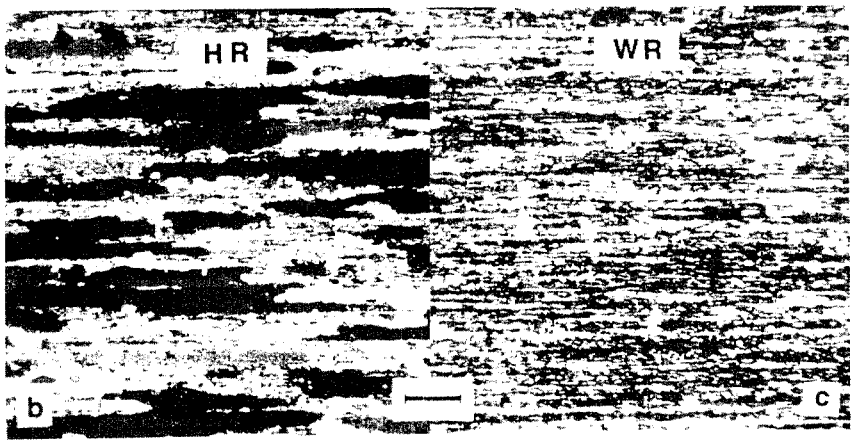
Figures 4D, 4E:
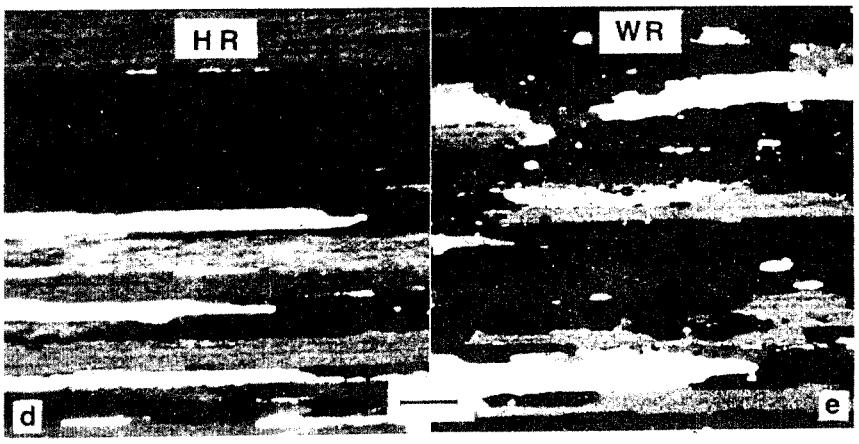

The pole figures of the solution heat treated plate in FIG. 3 show that both the (001) (100) recrystallized and the (111) (112) deformation textures are present. Both processing variants show similar texture development, but the strength of the cube texture of the warm rolled condition in FIG. 3*a* is sharper, and the maximum intensity observed in the pole figure is approximately 45% stronger (14.22 times random vs. 9.02 times random) than that of the hot rolled texture in FIG. 3*b*. The L-T-S grain structures observed in FIG. 4 support this observation. The hot rolled condition has a more uniform, small recrystallized grain structure, but the warm rolled condition yielded a heterogeneous recrystallized grain structure with large recrystallized grains and very fine, equiaxed recrystallized grains. The presence of this mixed grain structure may have a beneficial effect on fatigue crack growth characteristics in the lower range of stress intensities by its influence on crack closure (17-19). FIG. 4 compares the microstructure of billet slab, plate and sheet, showing that significant recrystallization occurred in the sheet. This is surprising since the tensile properties of the sheet are almost as high as the plate.

DISCUSSION

2XXX alloys are precipitation hardened by zone formation and partially coherent $Al_2CuMg$, or $Al_2Cu$. Extension of the limits of solid solubility of the age hardening solutes, Cu and Mg, is not a realistic avenue for alloy design using P/M techniques since these solutes are quite mobile at the processing temperatures for 2XXX aluminum alloys. Benefits from P/M in systems such as these arise from improved control of microstructure and possibly from a contribution of second phase hardening by the use of additional solute species resistant to coarsening and not useable in effective amounts by I/M processing. Of the alloys evaluated in this study, only the ones in Table 2 demonstrated improvements in tensile and toughness properties competitive with 2XXX I/M alloys.

The most promising P/M alloys are based on 2024 and 2219 (Alloys 514041, 514042, and Alloy 513887 in Table 2). Alloys 514042 and 513708 show that a large addition to aluminum of a highly insoluble, slow diffuser such as zirconium is better than a more soluble species like manganese. Zirconium produced a very small coherent phase of about 10 nm while manganese produced a larger incoherent ternary phase (6, 20). The zirconium phase more effectively controlled grain structure, producing an alloy with better strength and toughness. An I/M alloy of either composition would have gross equilibrium, tetragonal $Al_3Zr$ or $Al_{20}Mn_3Cu_2$, respectively, and a concomitant degradation in toughness.

We have included an I/M control alloy of a similar composition, 503315, to the P/M Alloy 514041. The zirconium content of this alloy is as large as I/M processing will allow in reasonably sized ingots. Comparing the data for extrusions in Table 3, for Alloys 514041 and 513315, one finds that the P/M alloy has a 20 MPa (3 ksi) yield strength advantage in the naturally aged temper, but a similar 20 MPa (3 ksi) disadvantage in aged yield strength. The two alloys show identical naturally aged tensile strengths, but the I/M alloy has about 10% higher tensile strength after aging. This effect also has been observed in 2XXX P/M alloys by others (2, 20). We believe the disadvantage of the P/M alloy after aging is a reflection on the competition for heterogeneous precipitation between the ineffective intergranular subgrain and grain boundaries and the effective intragranular dislocation sites. As the surface area of subgrain and grain boundaries increases, the relative amount of ineffective precipitation on them increases. (This effect will contribute to a higher quench sensitivity of P/M alloys which also will reduce maximum attainable strengths, especially in thicker sections).

It was expected that as section size decreased the P/M alloy will show increasing strength-toughness advantage over the I/M alloy by its superior ability to control recrystallization with high zirconium content. This benefit was obtained in the 1.6 mm (0.070 in.) sheet which had equivalent aged tensile properties to the thicker plate. Both these P/M alloy product forms showed a 69 MPa (10 ksi) advantage in naturally aged yield strength over the best I/M 2XXX alloy in similar section thicknesses. The tensile strength of the P/M alloys was very similar to the best I/M 2XXX alloy. Quite remarkably, the microstructures of the sheet in FIG. 4, shows that recrystallization occurred, but high strength was maintained. The high strengths must arise from either a different texture evolution or the contribution to hardening by the zirconium aluminide. The performance of Alloys 514041 and 514042 show that rapid solidification can be used to control large amounts of the highly insoluble element, Zr, producing useful microstructures with improved tensile properties and toughness.

The response of the extrusion of Alloy 513887 also was promising. While this alloy (similar to I/M 2219 but with zirconium addition) had relatively low naturally aged tensile properties and toughness, its artificially aged condition showed properties comparable to those of the Al-Cu-Mg P/M alloys. This alloy may offer more competitive properties if solute additions are used to better control grain structure in fabrication. The tensile properties of the P/M alloy are significantly better than that of the I/M 2219 alloy counterpart.

CONCLUSION

This evaluation of 2XXX aluminum alloys has shown that rapid solidification processing can be used to significantly improve the performance of 2XXX compositions. The best P/M alloy found in this study is based on the 2124 composition with manganese and zirconium modifications to improve strength and toughness. Zirconium additions of as much as 0.6 wt % have been used successfully, while the practical limit of Zr addition used in I/M alloys is approximately 0.10–0.15 wt %. An aged alloy based on 2219 also showed promising properties. It is anticipated that further compositional refinement of this alloy could result in an artificially aged alloy with comparable tensile properties to the 2024-based alloy, and with the improved elevated temperature strength associated with a theta' microstructure.

As the product section thickness is reduced, the advantage of the P/M alloys containing zirconium increases greatly by their innately better ability to control grain structure. These results again show that one may expect better performance of P/M microstructures over I/M alloys, but compositional modifications may be necessary to effectively control recrystallization.

ACKNOWLEDGEMENT

The alloy development and characterization studies reported in this paper have been supported in part by a NASA - Langley Research Center contract on high temperature aluminum alloys, Contract NAS1-16048, with W. B. (Barry) Lisagor, Jr. as Technical Monitor.

BIBLIOGRAPHY

1. F. R. Billman, J. C. Kuli, G. J. Hildeman, J. I. Petit and J. A. Walker, *Rapid Solidification Processing, Principles and Technologies III*, ed. Robert Mehrabian, National Bureau of Standards (1983), page 532.
2. D. P. Voss, "Structure and Mechanical Properties of Powder Metallurgy 2024 and 7075 Aluminum Alloys", AFOSR Grant #77-3440, Final Report, October, 1979.
3. M. Lebo and N. J. Grant, *Met. Trans.*, Volume 5, (1974), page 1547.
4. G. G. Wald, D. J. Chellman and H. G. Paris, First Annual Report on "Development of Powder Metallurgy 2XXX Series Al Alloys, Supersonic Cruise Vehicle Technology Assessment Study of an Over-/Under Engine Concept - Advanced Aluminum Alloy Evaluation", NASA Contractor Report #165676, May, 1981, Lockheed-California Company.
5. D. J. Chellman, G. G. Wald, H. G. Paris and J. A. Walker, Second Annual Report on "Development of Powder Metallurgy 2XXX Series Al Alloys, Development of Powder Metallurgy 2XXX Series Alloys for High Temperature Aircraft Structural Applications - Phase II", Final Report, NASA Contractor Report #165965, August, 1981, Lockheed-California Company.
6. D. J. Chellman, G. G. Wald, H. G. Paris and J. A. Walker, Third Annual Report on "Development of Powder Metallurgy 2XXX Series Al Alloys, Development of Powder Metallurgy 2XXX Series Al Alloys for High Temperature Aircraft Structural Applications - Phase III", Draft Report, NASA Contractor Report, 1984, Lockheed-California Company, In Press.
7. A. P. Haar, U.S. Army Contract DA-36-034-ORD-3559RD, Final Report Section III, May, 1966.
8. J. P. Lyle, Jr. and R. J. Towner, U.S. Pat. No. 3,544,392, December, 1970.
9. J. P. Lyle, Jr. and R. J. Towner, U.S. Pat. No. 3,544,394, December, 1970.
10. J. P. Lyle, Jr. and R. J. Towner, U.S. Pat. No. 3,563,814, February, 1971.
11. J. P. Lyle, Jr. and R. J. Towner, U.S. Pat. No. 3,637,441, January, 1972.
12. W. S. Cebulak, U.S. Army Contract DAAA25-72-C0593, Final Report Phase IVB, FA-TR-76067, April, 1977.
13. D. L. Robinson, *Met. Trans.*, Volume 3, (1972), page 1147.
14. R. Ichikawa and T. Ohashi, *J. Jpn. Inst. Light Met.*, Volume 18, (1968), page 314.
15. N. Ryum, *Acta Met.*, Volume 17, (1969), page 269.
16. --, "Rapid Inexpensive Tests for Determining Fracture Toughness", Report of The Committee on Rapid Inexpensive Tests for Determining Fracture Toughness, National Materials Advisory Board, National Academy of Sciences, 1976.
17. S. Suresh and R. O. Ritche, *Met. Trans.*, 13A, (1982), page 1627.
18. J. I. Petit and P. E. Bretz, *High Strength Powder Metallurgy Aluminum Alloys*, Proceedings of the Conference on High Strength Powder Metallurgy Aluminum Alloys, 111th AIME Meeting, Dallas, Tex., Feb. 17–18, 1982, Ed. Michael J. Koczak and Gregory J. Hildeman, The Metallurgical Society of AIME, (1982), page 147.
19. P. E. Bretz, J. I. Petit and A. K. Vasudevan, *Concepts of Fatigue Crack Growth Thresholds*, Proceedings of the AIME Conference, October, 1983, Philadelphia, Pa., Editors D. L. Davidson and S. Suresh, (1984), In Press.
20. J. I. Petit, "Structure and Properties of Three P/M Processed Al-Cu-Mg Alloys", M. S. Thesis, Mass. Inst. Tech., Cambridge, Massachusetts, 1980.

FURTHER DESCRIPTION of PREFERRED EMBODIMENTS

A preferred range (wt %) of an alloy according to the present invention is:

| | | Nominal Composition | | |
|---|---|---|---|---|
| | | Type 1 | Type 2 | Type 3 |
| Preferred Range (wt %) | | | | |
| Elements: | | | | |
| Cu | 3 to 7 | 3.75 | 6 | 4 |
| Mg | 0 to 2.5 | 1.75 | 0 | 2 |
| Zr | 0.2 to 1 | 0.6 | 0.6 | 0.6 |
| Mn | up to 0.5 | 0.15 | 0.15 | Fe |
| O | | 0.35 | 0.35 | 0.35 |
| Fe | | | | 0.35 |
| Ni | | | | 0.5 |
| Impurities: | | | | |
| Fe | up to 0.5 | | | |
| Si | up to 0.5 | | | |
| Others | each less than 0.15 | | | |
| More Preferred Range (wt %) | | | | |
| Elements: | | | | |
| Cu | 3 to 4.5 | | | |
| Mg | 1.25 to 2.25 | | | |
| Zr | 0.3 to 0.8 | | | |
| Mn | up to 0.5 | | | |
| Impurities: | | | | |
| Fe | up to 0.15 | | | |
| Si | up to 0.15 | | | |
| Others | each less than 0.05 | | | |

The significance of the elements is as follows: Cu and Mg provide strength by precipitation of $Al_2CuMg$. Zr is the key difference. It suppresses recrystallization under conditions that usually cause it to happen. As a result, strength is substantially higher.

As a characteristic of powder metallurgy, the above compositions will typically contain as well 0.3 to 0.7 wt % oxygen, in the form of aluminum oxide on the surfaces of the particles. Thus, the nominal compositions show 0.35 wt % oxygen.

Figure 5:
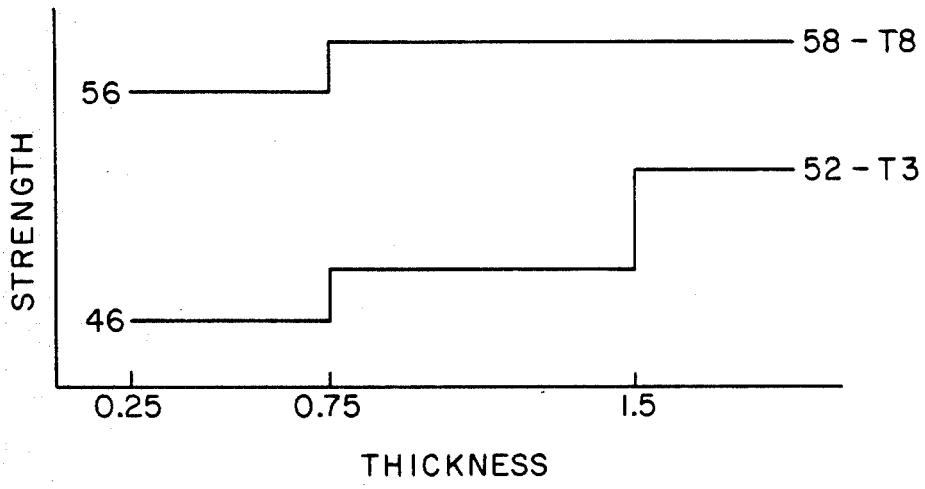
FIG. 5 shows behavior of a prior art Alloy 2024.

The present invention overcomes the drawback that guaranteed tensile properties of the Alloy 2024 extrusions decrease as section size decreases because of recrystallization during solution heat treatment, as shown in FIG. 5.

The working operations of the present invention are as follows. Rapidly solidified particles are cold compacted with vacuum degassing—hot pressed under vacuum to equal 100% density. The product is extruded between 500°–850° F.; SHT (solution heat treating) by heating about to 910° F., followed by CWQ (cold water quench), and stretched between 1 to 5%.

The present invention produces an extruded product with high strength and toughness.

The times and temperatures of the solution heat treatment are long enough to dissolve the $Al_2CuMg$.

The quench must be sufficiently fast. If the quench is too slow during precipitation of $Al_2CuMg$, the result will be coarse particles, yielding decreased corrosion resistance, toughness and strength.

Stretching improves both flatness and properties.

Artificial aging for 16 hours is typical, while natural aging involves 4 days minimum. Artificial aging at longer times at lower T or artificial aging at shorter times at higher T is acceptable.

The present invention presents a new process of fabricating the alloy as well as a new product. With conventional ingot metallurgy, only about 0.12% Zr can be added to Al alloys. With rapid solidification (equal to $10^{4°}$–$10^{6°}$ C./sec) about 1% can be added. The Zr precipitates as fine particles of $ZrAl_3$ which suppress recrystallization and increase strength.

The advantages of the present invention are as follows. It provides a product in thin extrusions which has an unrecrystallized structure. Prior art thin extrusions are recrystallized. Unrecrystallized structures are stronger and tougher. Therefore, the properties of the product are unique.

Percentages herein are percent-by-weight, unless noted otherwise.

While the invention has been described in terms of preferred embodiments, the claims appended hereto are intended to encompass all embodiments which fall within the spirit of the invention.

What is claimed is:

1. A metallurgical method including cooling molten aluminum particles and consolidating resulting solidified particles into a multi-particle body, wherein the improvement comprises provision in the particles of an elemental composition consisting essentally of 3–4.5 wt % Cu, 1.25–2.25 wt % Mg, up to 0.5 wt % Mn, and greater than 0.15% of a metal which diffuses in the aluminum solid state at a rate less than that of Mn, the body being based on an average particle size (APD) of about 15 micrometers, whereby, in 1.9×7.6 cm extrusions, toughness increases with increasing strength and toughness $K_r$ values above 100 MPa·m$^{\frac{1}{2}}$ at longitudinal yield strengths above 450 MPa may be achieved.

2. A method as claimed in claim 1, said metal being selected from the group consisting of Zr, Ti, Hf, W, Ta and V.

3. A method as claimed in claim 1, grain refining elements of diffusion rate of Mn or above being present about only to their solubility limit at room temperature.

4. A method as claimed in claim 2, the particles containing 0.2–1 wt % Zr.

5. A method as claimed in claim 4, the Zr content falling in the range 0.3–0.8 wt % Zr.

6. An aluminum base alloy powder of average particle size (APD) of about 15 micrometers, consisting essentially of aluminum, 3–4.5 wt % Cu, 1.25–2.25 wt % Mg, 0.3–0.8 wt % Zr and up to 0.5 wt % Mn, whereby, in 1.9×7.6 cm extrusions, toughness increases with increasing strength and toughness $K_r$ values above 100 MPa·m$^{\frac{1}{2}}$ at longitudinal yield strengths above 450 MPa may be achieved.

7. A consolidated aluminum alloy metal particle composition consisting essentially of aluminum, 3–4.5 wt % Cu, 1.25–2.25 wt % Mg, 0.3–0.8 wt % Zr and up to 0.5 wt % Mn, the average particle size (APD) being about 15 micrometers, the composition providing, in 1.9×7.6 cm extrusions, increasing toughness with increasing strength and toughness $K_r$ values above 100 MPa·m$^{\frac{1}{2}}$ at longitudinal yield strengths above 450 MPa.

* * * * *